United States Patent [19]

Fillios et al.

[11] 4,072,141

[45] Feb. 7, 1978

[54] PREFABRICATED VENTILATING PANEL INCLUDING HEAT TRANSFER MEANS

[75] Inventors: Jean-Pierre Fillios; Joseph Kergueno, both of Saint Germain-en-Laye, France

[73] Assignee: Multifluid-Energie, Societe Anonyme, Les Mureaux, France

[21] Appl. No.: 688,684

[22] Filed: May 21, 1976

[30] Foreign Application Priority Data

May 22, 1975 France ..... 75 15904

[51] Int. Cl.[2] ..... F24J 3/02

[52] U.S. Cl. ..... 126/270; 98/31; 237/1 A

[58] Field of Search ..... 98/31, 37; 237/1 A, 237/46; 126/270; 236/49; 165/16

[56] References Cited

U.S. PATENT DOCUMENTS

| | | | |
|---|---|---|---|
| 246,626 | 9/1881 | Morse | 237/1 A |
| 1,974,767 | 9/1934 | Clark | 98/31 UX |
| 2,484,127 | 10/1949 | Stelzer | 237/1 A |
| 2,559,869 | 7/1951 | Gay | 237/1 A |
| 2,706,442 | 4/1955 | Risley | 98/31 |
| 3,952,947 | 4/1976 | Saunders | 237/1 A |
| 3,994,276 | 11/1976 | Pulver | 237/1 A |

*Primary Examiner*—William E. Wayner
*Attorney, Agent, or Firm*—Lawrence E. Laubscher

[57] ABSTRACT

A prefabricated ventilating panel including heat transfer means is disclosed for supplying air to an enclosure, including a vertical core member formed of heat insulating a material, a vertical outer facing member formed of heat conductive material arranged in parallel spaced relation to said core member, means defining at least one vertical passage between said outer facing and core members, air inlet means for supplying air to the lower end of said vertical passage, and generally horizontal passage means connected at one end with the upper end of the vertical passage and extending horizontally through the core member. Consequently, air introduced via the inlet opening flows upwardly through the vertical passage in heat transfer relation with the outer facing member and through the horizontal passage means for discharge into the enclosure. Damper means are provided for alternately connecting the horizontal passage means with the vertical passage and with a by-pass air opening, respectively.

8 Claims, 4 Drawing Figures

Fig. 1
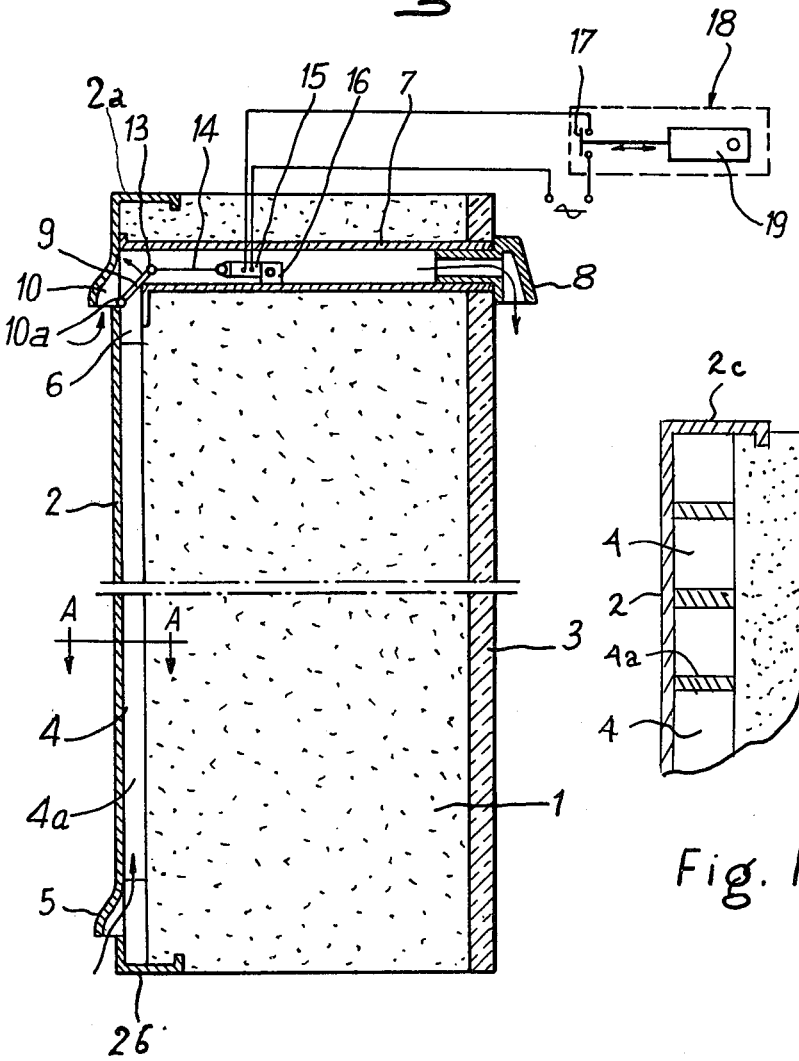
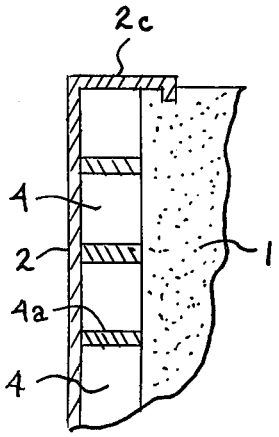
Fig. 1A

PREFABRICATED VENTILATING PANEL INCLUDING HEAT TRANSFER MEANS

BRIEF DESCRIPTION OF THE PRIOR ART

In the construction of walls for enclosures such as houses, buildings or the like it is known to provide ventilating means for admitting fresh air to the enclosure.

It is further known that heat leakage from an enclosure comes from leakage through the walls and leakage due to the renewal of the air of the enclosure. These losses are limited by use of wall material which has a low heat transfer coefficient, and also by limiting the rate of air renewal of the housing to a level which is suitable for comfort.

The walls can be, for example, constituted of composite panels including a relatively thick insulating core, an outer skin layer and an inner facing. The outer skin is often metallic, for the necessary mechanical characteristics, for facility in shaping, for good resistance to aging, and for the ease with which it is finished.

Control of air renewal is obtained by arranging calibrated air inlets in the facade walls of the principal rooms, the air being aspirated through suction openings situated in service rooms (kitchen, bathroom, recreation room) and connected by casings to a ventilator.

The air is admitted into the enclosure at the outside temperature and is heated by convection before evacuation through the openings.

SUMMARY OF THE INVENTION

The present invention was developed to provide a prefabricated ventilating panel in which the temperature of a heat-conductive facing plate is used to modify the temperature of ambient air that is introduced into an enclosure.

Thus, an objective of the present invention is to lower the heat requirement necessary for maintaining the desired temperature inside the enclosure during the heating season.

Accordingly, a primary object of the invention is to provide a prefabricated building panel comprising a core of insulating material and an outer skin or facing of heat-conductive material, wherein it includes, in the interfacing area of said materials, a plurality of conduits which communicate at one end of the panel with the outside atmosphere and which issue from the other end of the panel to the inside of the enclosure.

The panel which is thus constituted has the insulation characteristics expected because of its construction, and moreover, causes the fresh air admitted to the residence to be heated according to a process described hereinafter.

The composite panels of the type considered have certain particular properties from the point of view of heat transfer. Customarily, the quantity of heat Q transmitted through a wall is determined by the following formula:

$$Q = KS/e\,(T - t)$$

wherein $S$ and $e$ are, respectively, the surface and the thickness of the wall, $T$ and $t$ are the temperatures outside and inside, and K is the transfer coefficient of the wall.

In the case of a composite wall, this coefficient is determined as a function of the thicknesses and the coefficients which can be assigned to each of the wall constituants according to the following relationship:

$$1/K = e1/K1 + e2/K2 + \ldots$$

It is seen that the aggregate coefficient K of a composite wall constituted of a thin outer skin of conductive material (high K1) and a thick core of insulating material (very low K2) differs very little from the relative coefficient of the core itself, considered separately, since the $e_1 / K_1$ ratio relative to the skin is almost negligible in comparison to the $e_2 / K_2$ ratio relative to the core. At any rate, the behavior of such a composite wall is found to be relatively different from that of a homogenous wall with the same transfer coefficient.

It is to be observed in fact that during the day the temperature of the outer facing or skin is substantially higher than the temperature of the ambient atmosphere, while during the night the inverse phenomenon is apparent. Thus, for a daytime temperature of 0° C, the skin temperature can attain 7° or more, while for a nighttime temperature of 0° C, the skin temperature can drop well below 0° C.

This can be attributed to absorption during the day and to radiation from the skin during the night, and these phenomena can be amplified by the presence of a very good insulation material directly behind this skin. A natural convection movement of the air is subsequently established, which tends to cool the outer skin by day and to heat it at night.

Because of this, in accordance with the present invention there are arranged a plurality of passages between the outer skin and the core of the panel in such a manner that the new air admitted into the housing during the heating season is heated during the day by contact with this skin in such a manner as to recover at least a part of the calories which are lost by convection, to be used to heat the enclosure. It should be noted that the heating of the outer skin is not remarkably modified by the presence of these new air passages, because of the fact that the air itself is a very good insulating medium.

During the night, the inverse effect is then attained, in other words a certain cooling of the fresh air which is admitted to the enclosure is effected. According to another object of the invention, the panel includes by-pass means so as to admit the atmospheric air directly into the housing during the night. These by-pass means can be operated, for example, by manual or automatic actuation of a damper means.

BRIEF DESCRIPTION OF THE DRAWING

Other objects and advantages of the invention will become apparent when viewed in the light of the accompanying drawing, in which:

FIG. 1 is a transverse sectional view of a prefabricated ventilating panel in accordance with the present invention;

FIG. 1A is a detailed sectional view taken along line A—A of FIG. 1.

DETAILED DESCRIPTION

Figure 2:
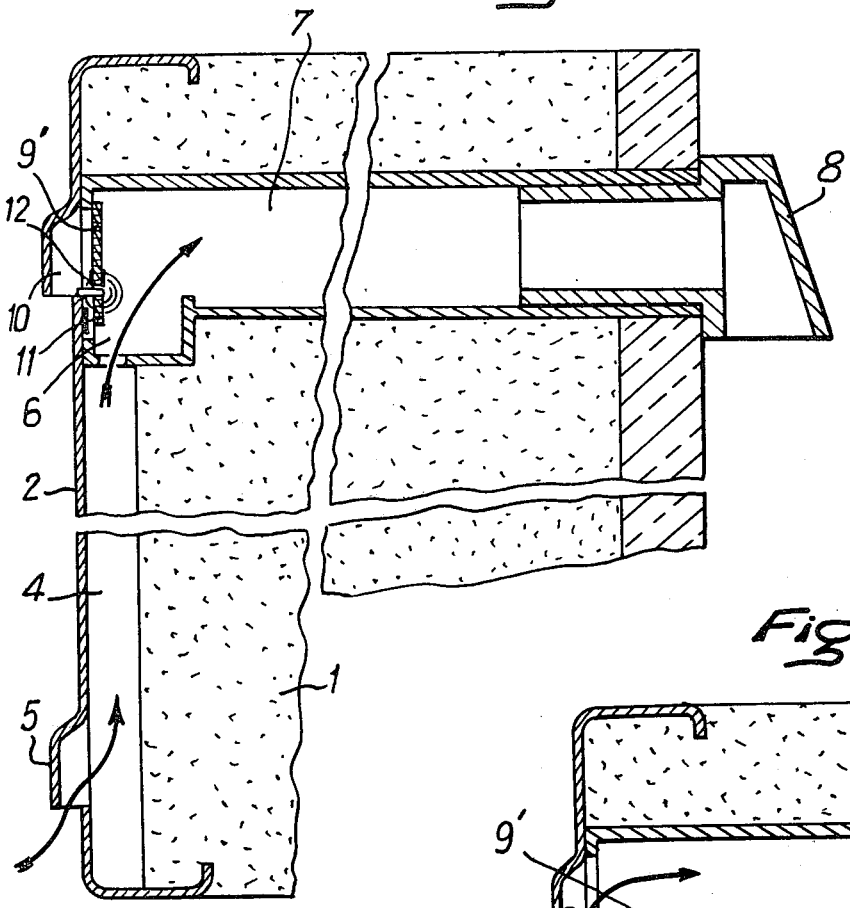
FIGS. 2 and 3 are detailed transverse sectional views of a second embodiment of the invention with the damper means in its first and second positions, respectively.

Referring first more particularly to FIG. 1, the prefabricated ventilating panel of the present invention includes a vertical core member 1 having a generally rectangular cross sectional configuration, said core member being formed of a suitable heat-insulating material (for example, a synthetic plastic material such as polyurethane or phenolic foam, asbestos fibers, or the like). A planer outer facing member 2 is connected by rearwardly directed lateral flange portions 2*a*, 2*b*, and 2*c* in parallel spaced relation to the outer wall of the core, and an inner facing member 3 is secured to the inner wall of the core member. The outer facing member 2 is formed of a suitable heat-conducting material, such as a sheet of aluminum, and the inner facing member 3 is formed of any suitable material, such as plaster, wood, a paper-foil laminate, or the like.

In accordance with the present invention, there are a number of generally vertical passages 4*a* between the adjacent spaced faces of the core member 1 and the outer facing member 2. An air inlet 5 is provided in the lower portion of the outer facing member 2 for admitting ambient air into the lower ends of the vertical passages 4.

At the upper end of the ventilating panel is provided a rearwardly extending generally horizontal passage 7 which extends completely through the panel, one end of the horizontal passage 7 being in communication with the upper ends of the vertical passages 4 by an L-connection 6, and the other end of the passage defining an outlet opening in communication with the interior of the enclosure. Deflector member 8 is mounted in the discharge end of horizontal passage 7 for directing downwardly in the enclosure the air that is discharged from the horizontal passage 7.

Adjacent its upper end the outer facing member 2 contains a by-pass opening 10 for admitting ambient air directly into the forward end of the horizontal passage 7. Damper means 9 are pivotally connected with the outer facing member 2 by pivot means 10*a*, said damper means being pivotally displaceable between first and second positions in which the horizontal passage 7 communicates solely with the vertical passages 4 and the by-pass opening 10, respectively. As shown in the embodiment of FIG. 1, the damper member 9 is pivotally operated by a solenoid 15 one end of which is pivotally connected with fixed block 16, and the plunger of which is connected to the free end of damper member 9 by connecting rod 14. The coil of solenoid 15 is connected with a voltage source by conductor means containing the contacts of a switch 17, said switch being operable by photoelectric-cell actuator means 18 containing a photo cell 19. Such photoelectric-cell actuator means are known, per se, in the art (as, for example, the photocell-actuated operator manufactured by Contacteur "LUMANDAR", COMETA S.A., B.P. 13, 38700 LaTrouche, France). The photoelectric cell 19 of the photocell-actuated operator means is sensitive to ambient daylight to effect operation of switch 17 for a given light intensity (for example, 4 lux). Thus, if the intensity of the ambient light is greater than the given value, switch 17 is opened and if the light intensity is less than the given value, switch 17 is closed. It is apparent therefore that the shifting of damper 9 between its first and second positions is directly controlled by the light of day. Consequently, when switch 17 is closed, solenoid 15 is energized to displace damper 9 toward the illustrated second position, thereby closing the upper ends of the vertical passages 4 to permit fresh air from the by-pass 10 to be supplied directly to the enclosure via horizontal passage means 7 and the deflector 8. When switch means 17 is opened, spring means of the solenoid displace the damper 9 in the counter clockwise direction to close by-pass opening 10 and to connect horizontal passage 7 with the upper ends of the vertical passages 4. In this case ambient air supplied by the inlet opening 4 passes upwardly through the vertical passages 4 in heat-transfer relationship with the outer facing member 2 and rearwardly through the passage 7 for discharge into the enclosure via deflector 8. During the summer, the switching operation may be reversed by conventional summer/winter changeover means, not shown, so as to avoid heating of the air introduced by day and to permit a relative cooling of the air introduced by night, thereby resulting in a lowering of the climate control costs.

Of course, it would be possible in accordance with the present invention to control a number of switches such as the switch 17 by means of suitable relays, said switches being mounted on a plurality of panels on one single building structure for control by one single photoelectric cell, thereby lowering the installation costs.

Figure 3:
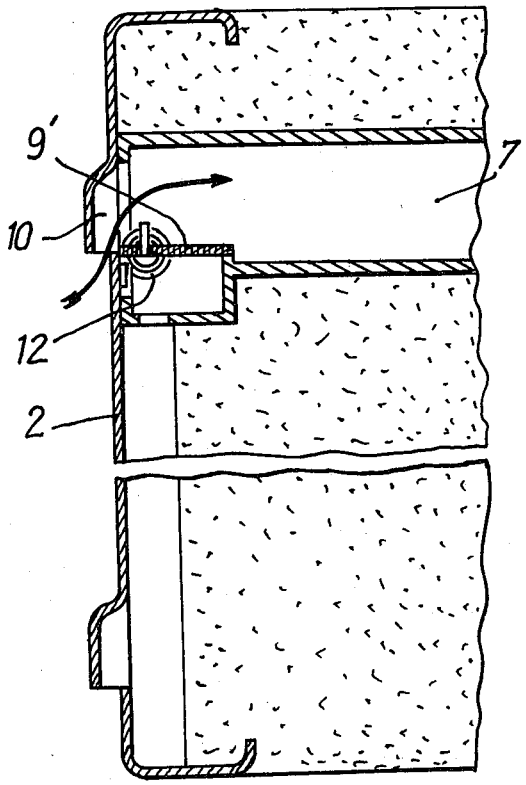

Referring now to FIGS. 2 and 3, a second embodiment of the invention is illustrated in which certain elements are the same and are identified by the same reference numerals as those illustrated in FIG. 1. In this embodiment, the damper member 9' is pivotally connected to the outer facing member 2 by means of pivot pin 11 for displacement between the first and second positions illustrated in FIGS. 2 and 3, respectively. Thus, when the damper member 9' is in the first (daytime) position of FIG. 2, the horizontal passage 7 is in communication with the upper ends of the vertical passage 4, and when the damper member 9' is in the second (nighttime) position of FIG. 3, the horizontal passage 7 is in communication only with the by-pass opening 10. The damper member 9' is pivotally operable between its first and second positions by a temperature responsive bimetallic spiral strip 12. The bimetallic spiral strip 12 is so designed that when it dilates, corresponding to at least one predetermined equilibrium temperature (which is a function of both the ambient temperature and the temperature of the metallic outer facing member 2) it causes movable damper 9' to close by-pass opening 10. When the effective equilibrium temperature is higher than the predetermined temperature corresponding to the characteristics of the strip, the damper is in the vertical position illustrated in FIG. 2. This is customarily the case during the daytime of the heating season. During such daytime periods, the ambient air is introduced via inlet opening 5 as shown by the arrows and passes upwardly through the vertical passages 4 in heat transfer relation with the outer facing member 2 and flows through the connection 6 and horizontal passage 7 for discharge into the enclosure via deflector means 8. The heat which is absorbed by the metallic wall 2 is thus partially transferred to the fresh air introduced into the enclosure, thereby lowering the heat requirements during the heating season.

During the nighttime of the heating season, the damper 9' has the position of FIG. 3; in this case, the effective equilibrium temperature of the bimetallic spiral strip is lower than the predetermined temperature proper for the characteristics of the strip. The fresh air is admitted directly into the enclosure via by-pass 10 passage 7 and deflector means 8 (in other words, at a temperature practically the same as the outside temperature).

The ventilating panel according to the present invention is used to reduce heating requirements of housing units regardless of the type of heating means, when they are provided with a mechanical ventilation device for control of the renewal rate of the air, and particularly in electric heating systems, wherein the heat generator can be constituted of convectors, electric radiant heat devices or pumps recovering the heat from the stale air extracted from the housing.

This limiting of the heat requirements is obtained essentially by causing the fresh air admitted into the enclosure to circulate behind the outer conductive skin of the composite ventilating panel, the by-pass means permitting the fresh air to be admitted directly from the outside into the enclosure during certain periods. It is to be understood that the switching logic of movable damper 9 can be adapted to specific use conditions without exceeding the limitations of the present invention.

As shown in the drawings, the air inlet opening 5 and the by-pass opening 10 are formed by punching the metal sheet 2 outwardly to define protective hood portions over the openings.

While in accordance with the provisions of the Patent Statutes the preferred forms and embodiments have been illustrated and described, it will be apparent that various changes and modifications may be made without deviating from the inventive concepts set forth above.

What is claimed is:

1. A prefabricated ventilating panel for supplying temperature modified air to an enclosure, comprising a. a vertical core member (1) formed of heat-insulating material;

b. a vertical planar outer facing member (2) formed of heat conducting material, said facing member being connected in parallel spaced relation with said core member;

c. mean defining at least one generally vertical passage (4) between said facing and core members;

d. means defining an air inlet opening (5) for supplying ambient air to the lower end of said vertical passage;

e. means (7) defining a generally horizontal passage which communicates at one end with the upper end of said vertical passage, said horizontal passage means extending rearwardly completely through said core member and terminating in an air discharge opening, whereby air introduced in said vertical passage via said inlet opening flows successively upwardly through said vertical passage in heat transfer relation with said outer facing panel and through said horizontal passage means for discharge into the enclosure; and f. means defining a by-pass opening (10) in said outer facing member adjacent the upper end of said vertical passage for introducing ambient air directly into said one end of said horizontal passage means.

2. A prefabricated ventilated panel for supplying temperature-modified air to an enclosure, comprising a. a vertical core member (1) formed of heat-insulating material;

b. a vertical planar outer facing member (2) formed of heat conducting material, said facing member being connected in parallel spaced relation with said core member;

c. means defining at least one generally vertical passage (4) between said facing and core members;

d. means defining an air inlet opening (5) for supplying ambient air to the lower end of said vertical passage;

e. means (7) defining a generally horizontal passage which communicates at one end with the upper end of said vertical passage, said horizontal passage means extending rearwardly completely through said core member and terminating in an air discharge opening, whereby air introduced in said vertical passage via said inlet opening flows successively upwardly through said vertical passage in heat transfer relation with said outer facing panel and through said horizontal passage means for discharge into the enclosure;

f. means defining a by-pass opening (10) in said outer facing member adjacent the upper end of said vertical passage for introducing ambient air directly into said one end of said horizontal passage means; and g. damper means (9) movably connected with said panel for displacement between first and second positions in which said horizontal passage means is alternately in communication solely with said vertical passage and with said by-pass opening, respectively.

3. Apparatus as defined in claim 2, and further including photocell-operated actuator means (18) responsive to the intensity of the ambient light for operating said damper means between said first and second positions, respectively.

4. Apparatus as defined in claim 2, and further including thermostat means for operating said damper means between said first and second positions in accordance with the ambient temperature.

5. Apparatus as defined in claim 2, and further including deflector means (8) connected with the discharge end of said horizontal passage means for directing the discharged air downwardly into the enclosure.

6. Apparatus as defined in claim 2, wherein said outer facing member is formed of sheet metal, said air inlet and by-pass openings being formed in said sheet metal outer facing member.

7. Apparatus as defined in claim 6, wherein said air inlet and by-pass openings are formed by punching the sheet metal facing member in the forward direction to define hood portions (5*a*, 10*a*) that overhang the air inlet and by-pass openings, respectively.

8. Apparatus as defined in claim 6, wherein said outer facing layer is provided at its upper and lower ends with rearwardly directed horizontal flange portions (2*a*, 2*b*) by means of which the outer facing layer is connected with said core member.

* * * * *